US007751771B2

(12) United States Patent
Ubayashi

(10) Patent No.: US 7,751,771 B2
(45) Date of Patent: Jul. 6, 2010

(54) SHEET TRANSPORT APPARATUS AND IMAGE FORMING APPARATUS

(75) Inventor: Shinsuke Ubayashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 11/216,009

(22) Filed: Sep. 1, 2005

(65) Prior Publication Data

US 2006/0051145 A1 Mar. 9, 2006

(30) Foreign Application Priority Data

Sep. 6, 2004 (JP) ..... 2004-258389

(51) Int. Cl.
*G03G 15/00* (2006.01)

(52) U.S. Cl. ..... 399/395; 399/396; 271/270; 271/265.03

(58) Field of Classification Search ..... 399/395, 399/396; 271/265.03, 270
See application file for complete search history.

(56) References Cited

U.S. PATENT DOCUMENTS

| | | | | |
|---|---|---|---|---|
| 5,478,066 | A | 12/1995 | Yoshida et al. | 271/12 |
| 5,645,274 | A | 7/1997 | Ubayashi et al. | 271/94 |
| 5,722,652 | A | 3/1998 | Yoshida et al. | 271/11 |
| 6,082,728 | A | 7/2000 | Ubayashi | 271/108 |
| 6,370,354 | B1 * | 4/2002 | Chapman et al. | 399/394 |
| 6,529,703 | B2 * | 3/2003 | Kawasumi et al. | 399/388 |
| 6,651,980 | B2 | 11/2003 | Isemura et al. | 271/259 |
| 6,697,601 | B1 * | 2/2004 | Kamimura et al. | 399/388 |
| 6,804,473 | B2 | 10/2004 | Nakamura et al. | 399/16 |
| 2004/0062582 | A1 * | 4/2004 | Dobbertin et al. | 399/394 |

FOREIGN PATENT DOCUMENTS

| | | |
|---|---|---|
| JP | 4-277151 | 10/1992 |
| JP | 2001-130812 | 5/2001 |
| JP | 2002-029649 | 1/2002 |

* cited by examiner

*Primary Examiner*—Judy Nguyen
*Assistant Examiner*—Andy L Pham
(74) *Attorney, Agent, or Firm*—Fitzpatrick, Cella, Harper & Scinto

(57) ABSTRACT

The present invention relates to a sheet transport apparatus comprising; sheet transport means capable of conveying sheets at a transfer speed that is the same as a transfer speed α of sheet in an image forming position where an image is formed on the sheet, and at a transfer speed β that is faster than the transfer speed α, skew feeding correction means which corrects skew feeding of sheet conveyed by the sheet transport means and which feeds the sheet to the image forming position where the image is formed, and sheet interval control means for controlling a distance between a sheet and a next sheet by changing timing at which the transfer speed of the sheet is reduced from the transfer speed β to the transfer speed α at upstream side from the skew feeding correction means in a sheet conveying direction.

4 Claims, 17 Drawing Sheets

SHEET TRANSPORT APPARATUS AND IMAGE FORMING APPARATUS

BACKGROUND OF THE INVENTION

1. Field of the Invention

The present invention relates to a sheet transport apparatus and an image forming apparatus, and more particularly to a sheet transport apparatus in an image forming apparatus having registration means which feeds sheets to image forming means.

2. Description of the Relates Art

A conventionally known image forming apparatus such as copying machines, printers, facsimile machines and a multi-function machines thereof includes an image forming unit for forming an image on a sheet, a sheet transport unit for feeding a sheet to the image forming unit, and a sheet discharging unit for discharging the sheet on which the image was formed by the image forming unit out from the image forming apparatus. There is also a known image forming apparatus having a sheet inverting transfer path which inverts a sheet on which an image was formed by the image forming unit to form images on both surfaces of the sheet and which feed the sheet to the image forming unit again.

A conventional example of such an image forming apparatus will be explained with reference to FIGS. 14 and 15. FIG. 14 is a schematic sectional view of an electrophotographic type copying machine as a conventional image forming apparatus. This electrophotographic type copying machine (simply copying machine, hereinafter) includes a document reading unit 4 for reading an image of an original, an image forming unit for forming an image on a sheet in an electrophotographic type based on image information read by the document reading unit 4, and a plurality of sheet transport units, and the copying machine can feed a plurality of sheets from each sheet transport unit to the image forming unit continuously.

In FIG. 14, a reference number 1 represents a copying machine body. An original base plate 2 comprising a clear glass plate is fixed to an upper portion of the copying machine body 1. A reference number 3 represents an original supplying apparatus. The original supplying apparatus 3 conveys originals to a predetermined position of the original base plate 2.

In the copying machine, an image of the original on the original base plate 2 is read by the document reading unit 4 and based on this data, a writing laser unit 5 in the image forming unit radiates laser light and scans the uniformly charged photosensitive member drum 12, thereby forming an electrostatic latent image on the photosensitive member drum 12.

The copying machine is provided with deck supply units 34 and 35 and cassette supply units 36 and 37 which supply decks 30 and 31 incorporated in the copying machine body 1 and sheets loaded on sheet cassettes 32 and 33.

The image forming unit includes the photosensitive member drum 12, a charger 13 for uniformly charging a surface of the photosensitive member drum 12, a development unit 14 which develops an electrostatic latent image formed on the surface of the photosensitive member drum 12 which is charged by the charger 13, and which forms a toner image to be transferred to a sheet S, a transfer charger 19 for transferring the toner image developed on the surface of the photosensitive member drum 12 to the sheet S, a separation charger 20 for separating the sheet S on which the toner image is transferred from the photosensitive member drum 12, and a cleaner 26 for removing toner remaining on the photosensitive member drum 12 after the toner image is transferred.

The image forming unit is provided at its downstream side with a transport unit 21 for transporting the sheet S on which the toner image is transferred, and a fixing unit 22 which fixes the toner image on the sheet S transported by the transport unit 21 as a permanent image. The image forming unit further includes an output roller 24 for discharging the sheet S on which the toner image is fixed by the fixing unit 22 from the copying machine body 1. The copying machine body 1 is provided at its outer side with an output tray 25 for receiving the sheet S discharged by the output roller 24.

In the copying machine, transport rollers 105, 107, 108, 109, 110, 111, 112 and 123 as sheet supply units, and sheet path sensors 104, 116, 117 and 118 for detecting a leading end and a rear end of the sheet are disposed on a transport path on which the sheet is transported from the sheet transport unit to the image forming unit. The sheet supplied by the transport rollers is fed to the image forming unit by a registration roller 106. A registration sensor 120 for detecting the leading end of the sheet is disposed in the vicinity of the upstream side of the registration roller 106 in the sheet conveying direction.

Here, the transport roller 107 is a pre-registration roller for feeding a sheet transported from the sheet transport unit to the registration roller 106. The first transport roller 105, the sheet path sensor 104, the second transport roller 108, the third transport roller 109, the sheet path sensor 116, the fourth transport roller 110 and the sheet path sensor 117 are disposed in this order on a sheet transport path upstream side of the pre-registration roller 107.

A sheet transport path connected to the deck supply unit 35 is branched from the transport path between the pre-registration roller 107 and the first transport roller 105. The fifth transport roller 111, the sheet path sensor 104, a sixth transport roller 112, a sheet path sensor 118 and a seventh transport roller 123 are disposed in this order on this sheet transport path.

A sheet inverting path is branched off from a transport path between the sixth transport roller 112 and the seventh transport roller 123. A sheet path sensor 119, a both-sided right roller 113, a both-sided left roller 114, an inverting roller 115 which rotates in both normal and reverse directions, and a sheet inverting unit 121 are disposed in this order from downstream side of the sheet inverting path. In this copying machine, to form images on both surfaces, a sheet on which an image is formed by the image forming unit is inverted by the sheet inverting unit 121 and the inverting roller 115 and fed to the sheet inverting path, and is again supplied to the image forming unit through the both-sided left roller 114, the both-sided right roller 113, the sixth transport roller 112, the fifth transport roller 111, the pre-registration roller 107 and the registration roller 106 in this order.

A driving force of a driving motor (not shown) is transmitted to the above-described rollers so that the rollers are rotated and driven. The rotations of the rollers are controlled by a control unit (not shown) based on detection results of the sheet path sensors.

Next, the operation of the conventional copying machine when a sheet is supplied will be explained with reference to FIG. 15 based on a case in which the sheet is supplied from a deck supply unit 34. FIG. 15 is a diagram showing a positional relation and the like of a leading end and a rear end of a sheet when the sheet is supplied from the deck supply unit 34.

When the supply of sheets is started, a pickup roller 101, a supply roller 102, a separation roller 103, the first transport roller 105 and the pre-registration roller 107 are rotated and driven by the driving motor. At that time, the registration roller 106 is still in its stopped state.

When the sheets are supplied, sheets S set in the sheet deck 30 are supplied to the supply roller 102 by the pickup roller 101. The sheet S is provided such as to be opposed to the supply roller 102, and a force rotating in the opposite direction to the conveying direction is given to the separation roller 103 with constant torque. Only the uppermost sheet is separated from the sheets S by the separation roller 103.

The leading end of this uppermost sheet is detected by the sheet pass sensor 104, and is conveyed by the first transport roller 105.

At that time, to adjust a interval between sheets, i.e., to carry out a so-called pre-registration operation, control is performed in such a manner that the rotation of the first transport roller 105 is temporary stopped based on the detection timing of the sheet leading end by the sheet pass sensor 104, the leading end of the sheet which is being transported by the first transport roller 105 is stopped at a predetermined position on the transport path, and after a predetermined time is elapsed, the rotation of the first transport roller 105 is restarted.

That is, in the sheet transport unit, a sheet whose leading end is in a normal loading position of the sheet deck 30, and a sheet whose leading end is located near the supply roller 102 are also supplied, the leading end positions when the supply is started are varied, and it is necessary to eliminate this variation at the upstream side of the registration roller 106.

More specifically, as shown in FIGS. 14 and 15, the first transport roller 105 is temporary stopped with timing at which the sheet leading end comes on the predetermined position (pre-registration position) A on the transport path after the sheet leading end is detected by the sheet pass sensor 104, and the stop position of the sheet leading end is confirmed. Then, control is performed to restart the first transport roller 105 based on time B (B=(distance C to the registration roller 106)/(sheet conveying speed β of the first transport roller 105 required until the sheet reaches the registration roller 106) at which it is assumed that the sheet leading end reaches the registration roller 106.

Thereafter, the sheet reaches the registration roller 106 through the pre-registration roller 107. Here, the sheet is supplied by a constant amount by the pre-registration roller 107 in a state which the leading end of the sheet butts against the stopped registration roller 106, and the entire sheet forms a loop, thereby correcting the skew of the sheet. Then, the registration roller 106 starts rotating at a constant speed (process speed) α, the sheet is fed to the image forming unit with timing of the image forming operation, and a toner image is transferred on the upper surface.

The sheet which passed the image forming unit is fed to the fixing unit 22 by the transport unit 21 and a toner image is fixed thereon. In the case of a single-sided copy, the sheet is placed on the output tray 25 through the output roller 24. In the case of a both-sided copy, the sheet is inverted by the sheet inverting unit 121 and then, the sheet is conveyed on the sheet inverting path by the inverting roller 115, the both-sided left roller 114 and the both-sided right roller 113, and is fed to the image forming unit again.

Here, as timing at which supply of second and subsequent sheets is started at the time of continuous feeding, the supply is started after a constant time is elapsed after the immediately preceding sheet restarted from the first transport roller 105, and the supply is controlled in the same manner as described above.

When sheets are continuously supplied from the other deck supply unit 35 or the cassette supply units 36 and 37 also, the same pre-registration operation is carried out. When sheets are transported from any one of the sheet transport unit and the both-sided copy is carried out, the rotation of the both-sided right roller 113 is temporary stopped between the sheet path sensor 119 and a merging portion between the deck supply unit 35 and the both-sided transport path based on detection timing of the sheet leading end by the sheet path sensor 119 on the both-sided transport path, and the pre-registration operation for restarting the rotation after a constant time is elapsed is carried out.

In this manner, according to the conventional copying machine, the variation in the sheet leading end position at the sheet transport unit is eliminated by carrying out the pre-registration operation, the position of the sheet leading end is defined, and the sheet is fed to the registration roller 106 stably. The conveying speed β on the transport path from the sheet transport unit to the registration roller 106 is set faster than the sheet conveying speed (process speed α of the registration roller 106) at the image forming unit so that even when the sheet is temporary stopped in the transport path by the pre-registration operation, the next sheet can catch up the immediately preceding sheet.

Japanese Patent Application Laid-open No. 2002-029649 discloses the following control.

In a high speed copying machine, the need for writing an image within a previously printed frame is increased, and deviation (0.5 mm or less) of a position where an image with respect to the sheet is written becomes a problem. Such positional deviations include three elements, i.e., a "leading end registration deviation" which is a positional deviation of the leading end in the sheet conveying direction, a "lateral end registration deviation" which is a positional deviation of an end of the sheet in the widthwise direction perpendicular to the sheet conveying direction, and an "skew feeding" in which a sheet is inclined in the sheet conveying direction. In the conventional example, the "leading end registration deviation" is caused by a difference in an entering degree of a sheet into the roller nip portion when the sheet butts against the registration roller (a thick sheet does not enter to the depth portion of the nip portion of the registration roller, and a thin sheet enters the depth portion of the nip portion), and is varied depending upon a connection variation of an electromagnetic clutch which starts rotation of the registration roller. The "lateral registration deviation" is varied due to positional deviations of the decks 30 and 31 and the each sheet cassettes 32 and 33, and due to insufficient pressing force of a pressing member (not shown) which presses the sheet in these units. The "skew feeding" has a problem that if the sheet butts against the registration roller to form a loop to correct the skew of the sheet, the sheet can not be corrected skew when the sheet has large skew amount.

To solve the problems of the conventional technique, it is conceived that skew feeding correcting apparatuses 200*a*, 200*b*, 201*a* and 201*b* and image writing position shifting apparatuses 202 and 203 as shown in FIGS. 16 and 17 are provided. The skew feeding correcting apparatuses correct the skew feeding of the sheet S utilizing a speed difference between the skew correcting rollers 200*a* and 200*b* whose speeds can independently be controlled, and the skew feeding correcting apparatuses obtain the speed difference from information of the two correction sensors 201*a* and 201*b* provided near the downstream sides of the rollers 200*a* and 200*b* and perform the control. Each of the image writing position shifting apparatuses comprises a leading end detection sensor 202 which detects the leading end of the sheet in the conveying direction, and a CIS sensor 203 which detects a position of an end (lateral end) of the sheet in the widthwise direction perpendicular to the conveying direction, and the image writing position shifting apparatus is disposed such that it can detect the position of the sheet before the timing at which the laser unit 5 starts writing on the photosensitive member drum 12. That is, the image writing position shifting apparatus is disposed downstream side from the skew feeding correcting apparatus and upstream side from the pre-transfer driving roller 309 which feeds the sheet, and the image writing position shifting apparatus moves the writing position of the laser unit 5 with respect to the photosensitive member drum 12 by a control unit (not shown) based on the information of these two sensors 202 and 203. With this, it is possible to realize the writing position with high precision, and to write an image on a sheet within a previously printed frame with high precision.

However, even if the interval between the sheets is adjusted by the pre-registration operation, transfer variation after the pre-registration operation generates slight deviation of interval between sheets. In the case of a static skew feeding correction in which skew feeding is corrected while butting a sheet leading end against the registration roller and stopping the sheet leading end after the pre-registration operation as shown in FIGS. 14 and 15, if the rotation starting time of the temporarily stopped registration roller is adjusted, it is possible to adjust the deviation of interval between sheets, but in the case of dynamic skew feeding correction in which the skew of the sheet is corrected by the speed difference between the two skew correcting rollers without stopping the sheet leading end as shown in FIGS. 16 and 17, especially when the number of sheets (PPM (Page Per Minute) hereinafter) to be printed per one minutes is high like a high speed copying machine, PPM is not stabilized by the slight deviation of interval between sheets, and even if the high precision writing position with respect to the sheet can be realized, there is a possibility that the productivity is not stabilized.

SUMMARY OF THE INVENTION

It is an object of the present invention to satisfy both the high precision writing position with respect to a sheet and the productivity even when skew feeding correction of the sheet is dynamically carried out without stopping the sheet leading end after the pre-registration operation.

To achieve the above object, the present invention is characterized in that.

DESCRIPTION OF THE PREFERRED EMBODIMENT

An image forming apparatus according to an embodiment of the present invention will be explained in detail with reference to the drawings. In the embodiment explained below, a copying machine as an image forming apparatus to which the invention is applied is shown.

Figure 1:
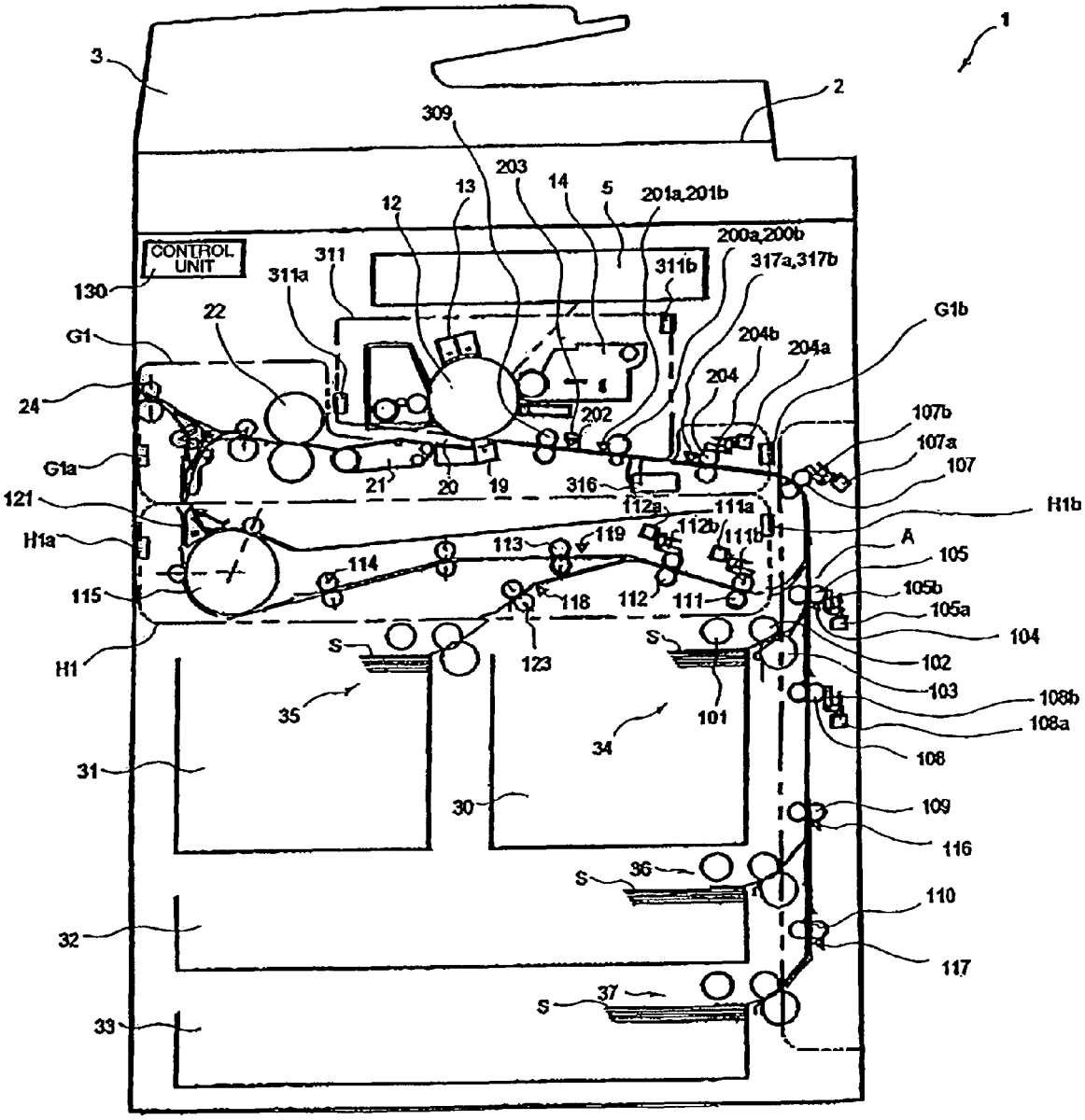
FIG. 1 is a schematic sectional view showing an outline structure of a copying machine according to an embodiment.
Figure 2:
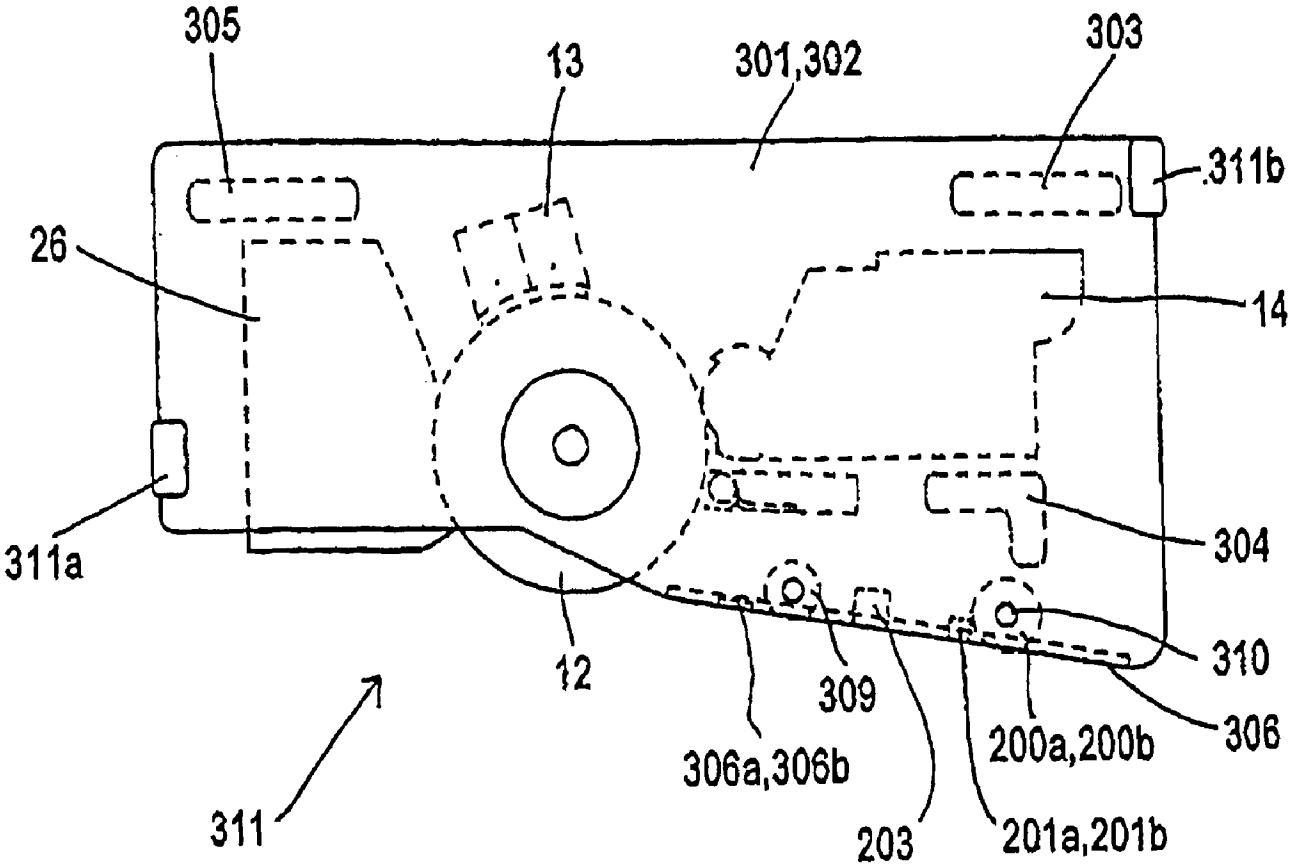
FIG. 2 is a schematic front view of an image forming unit in the copying machine.
Figure 3:
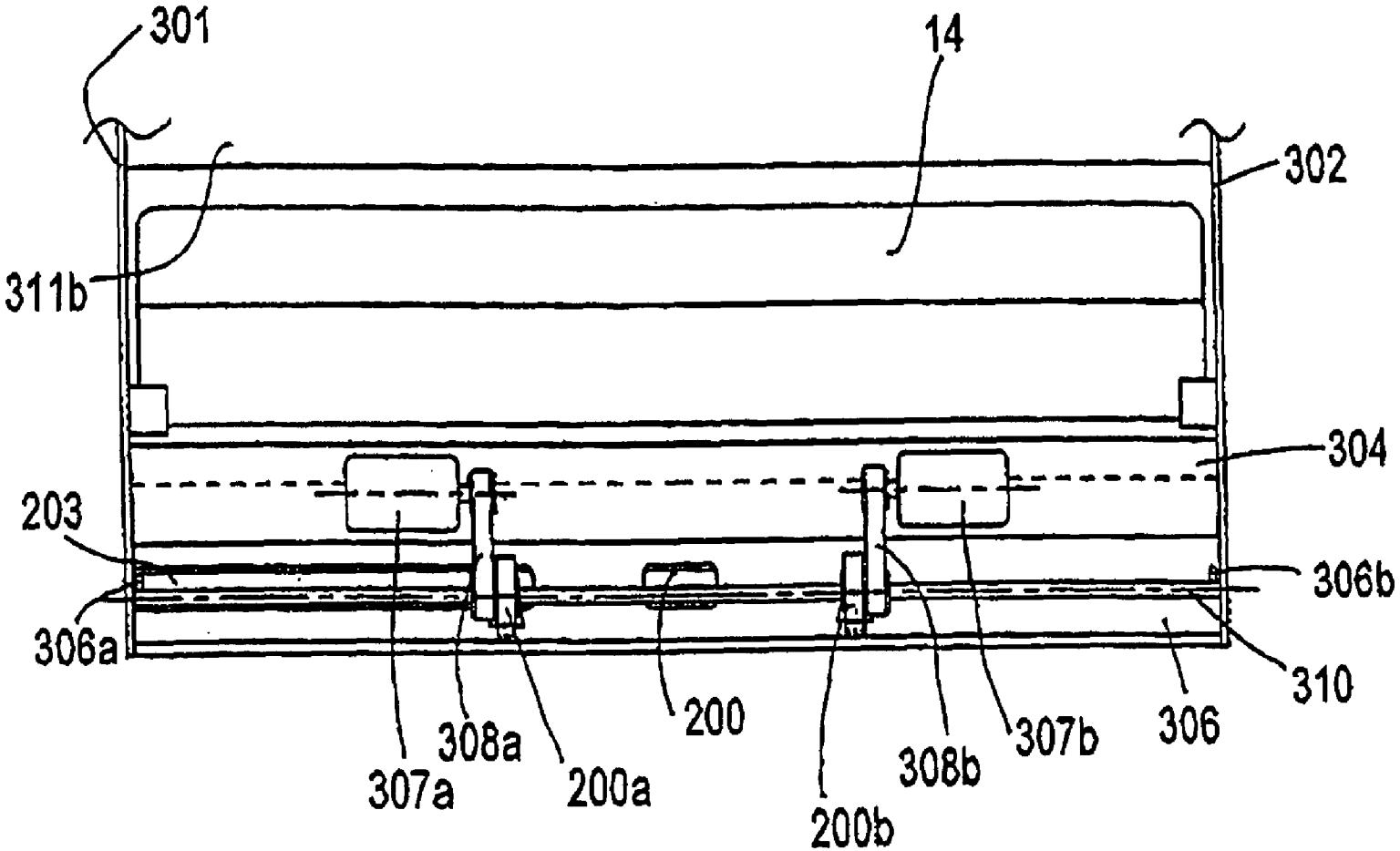
FIG. 3 is a sectional view of an essential portion of the image forming unit.
Figure 4:
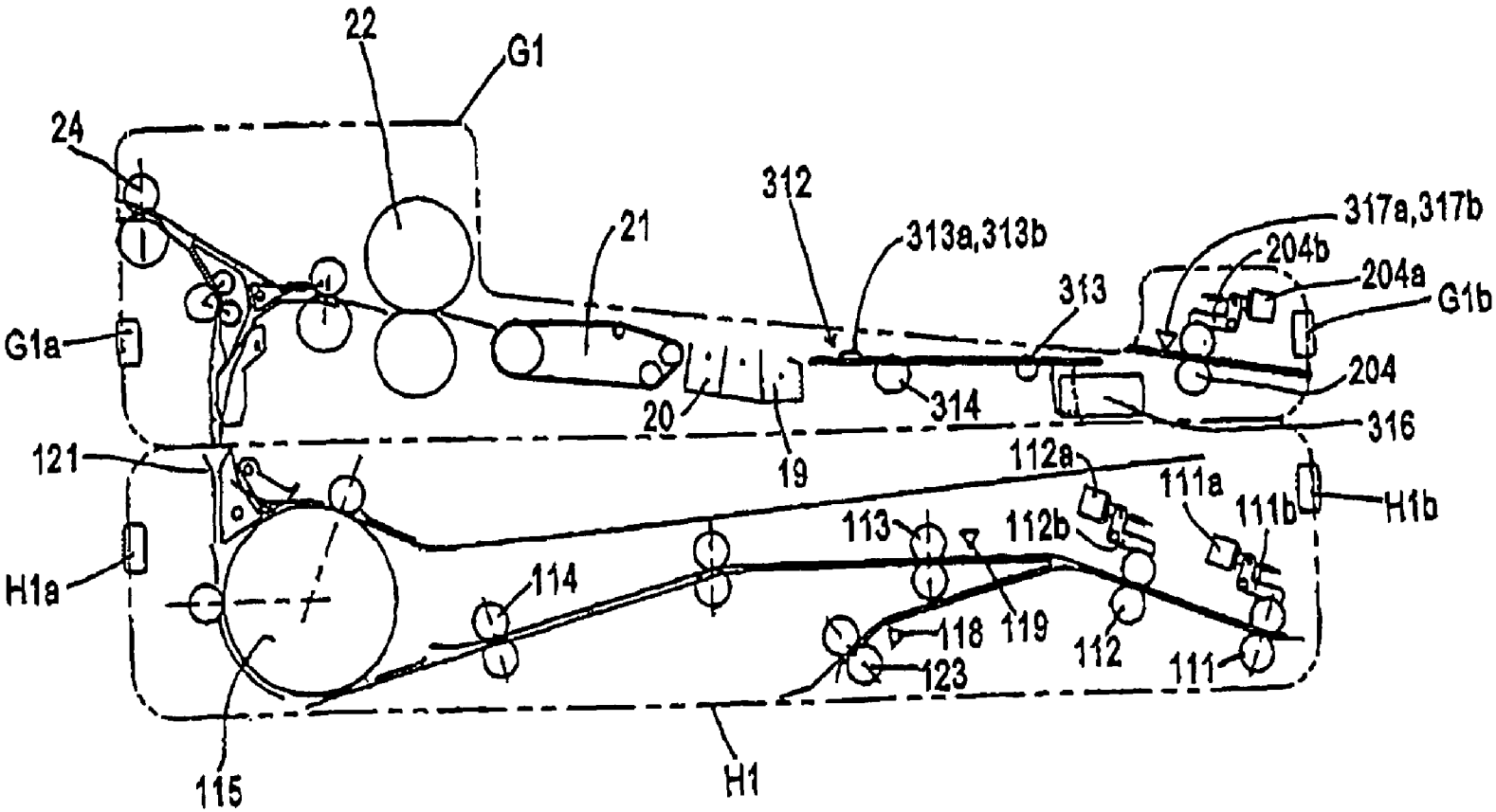
FIG. 4 is a side sectional view of two units in the copying machine.
Figure 5:
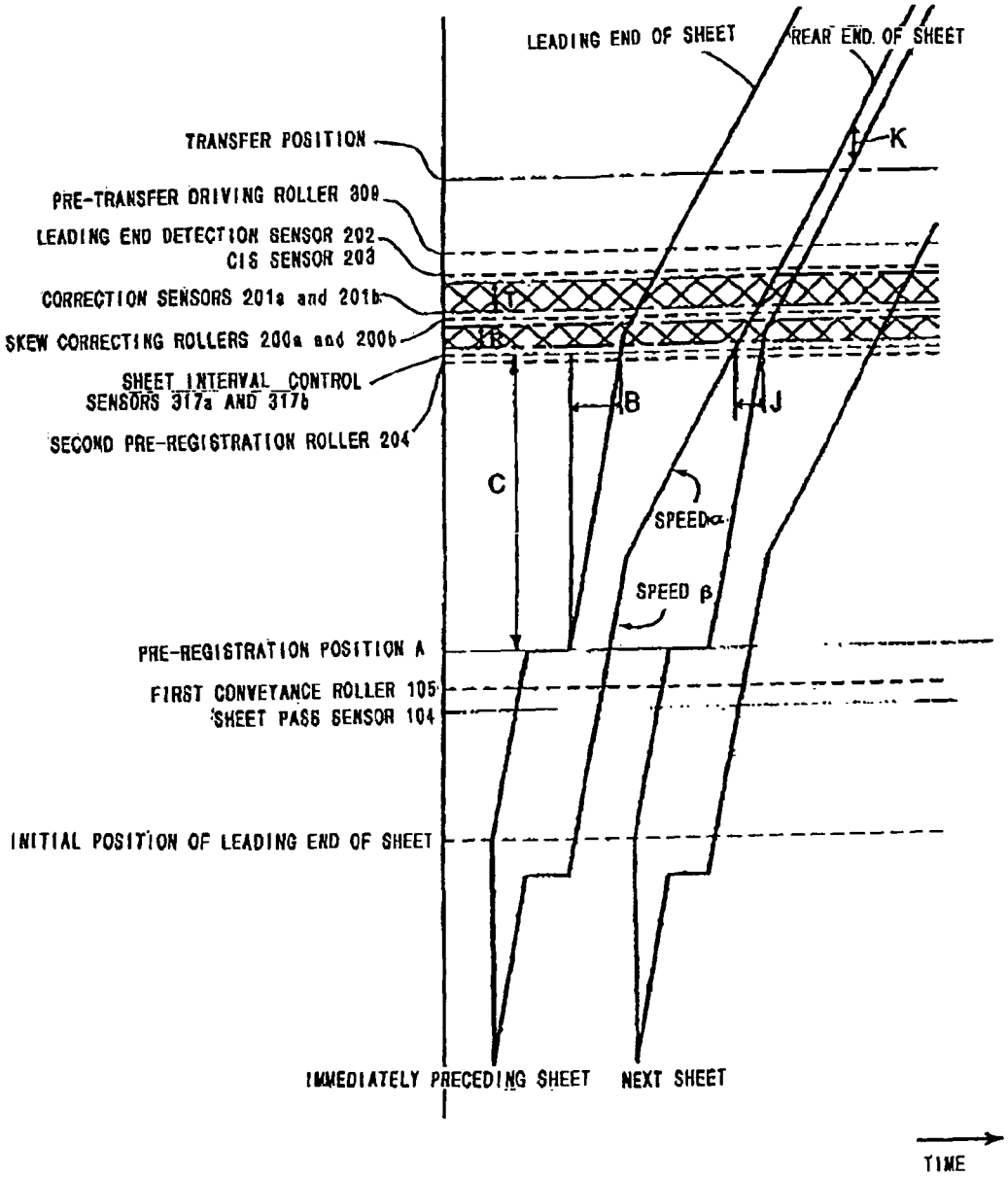
FIG. 5 is a diagram showing a positional relation and the like of a leading end and a rear end of a sheet when the sheet is supplied.
Figure 6:
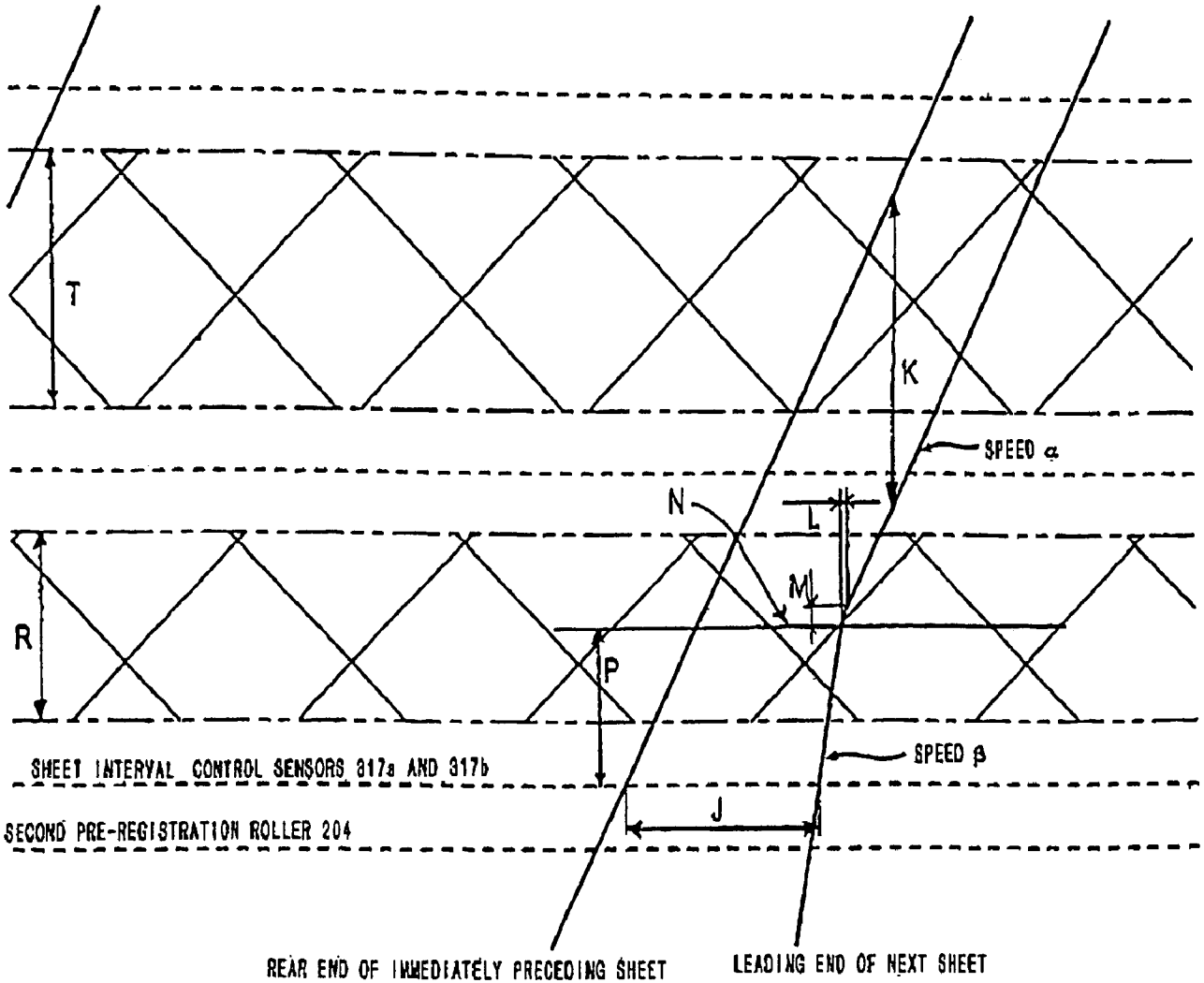
FIG. 6 is a partial enlarged view of the diagram shown in FIG. 5.
Figure 7:
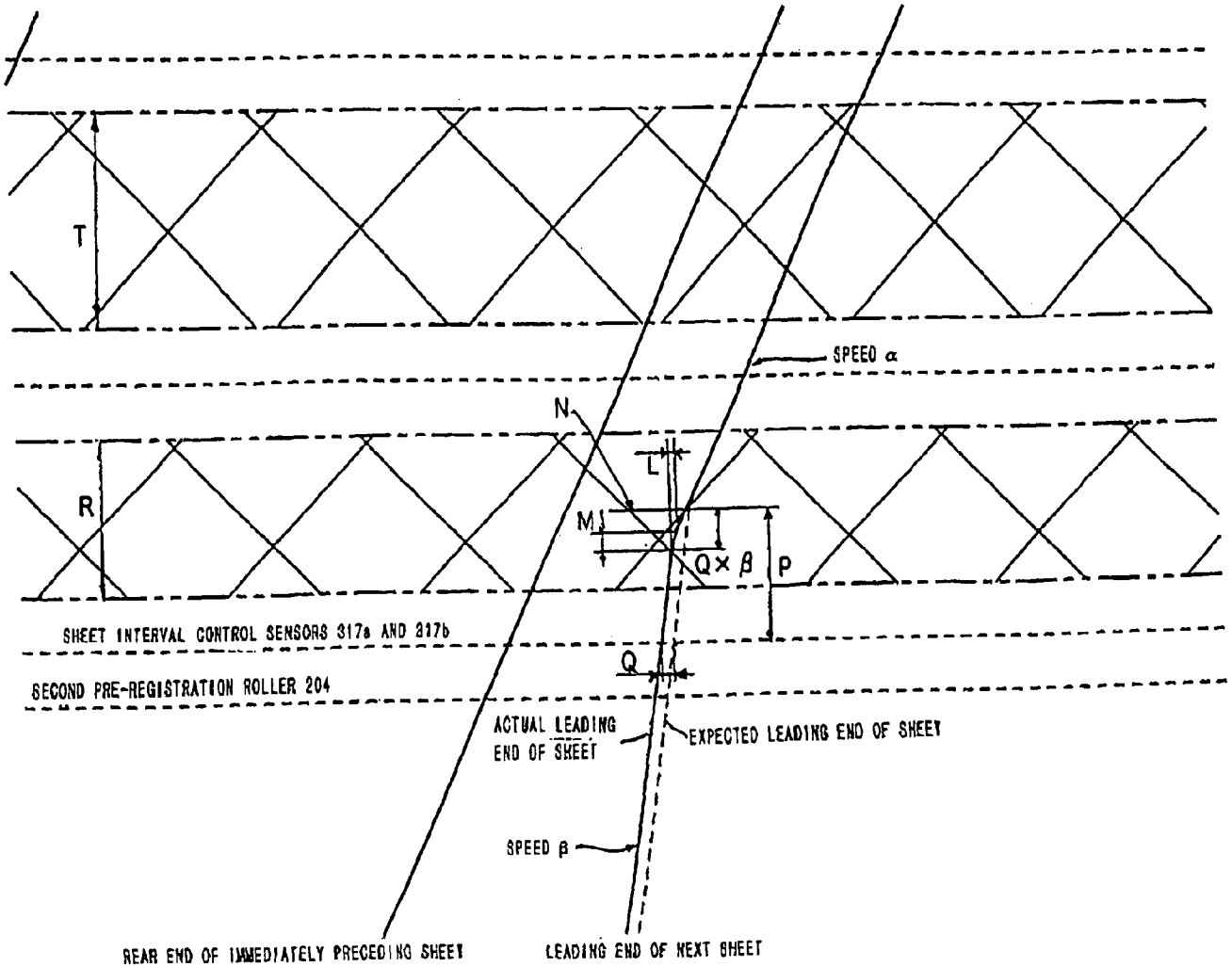
FIG. 7 is a partial enlarged view of the diagram shown in FIG. 5.
Figure 8:
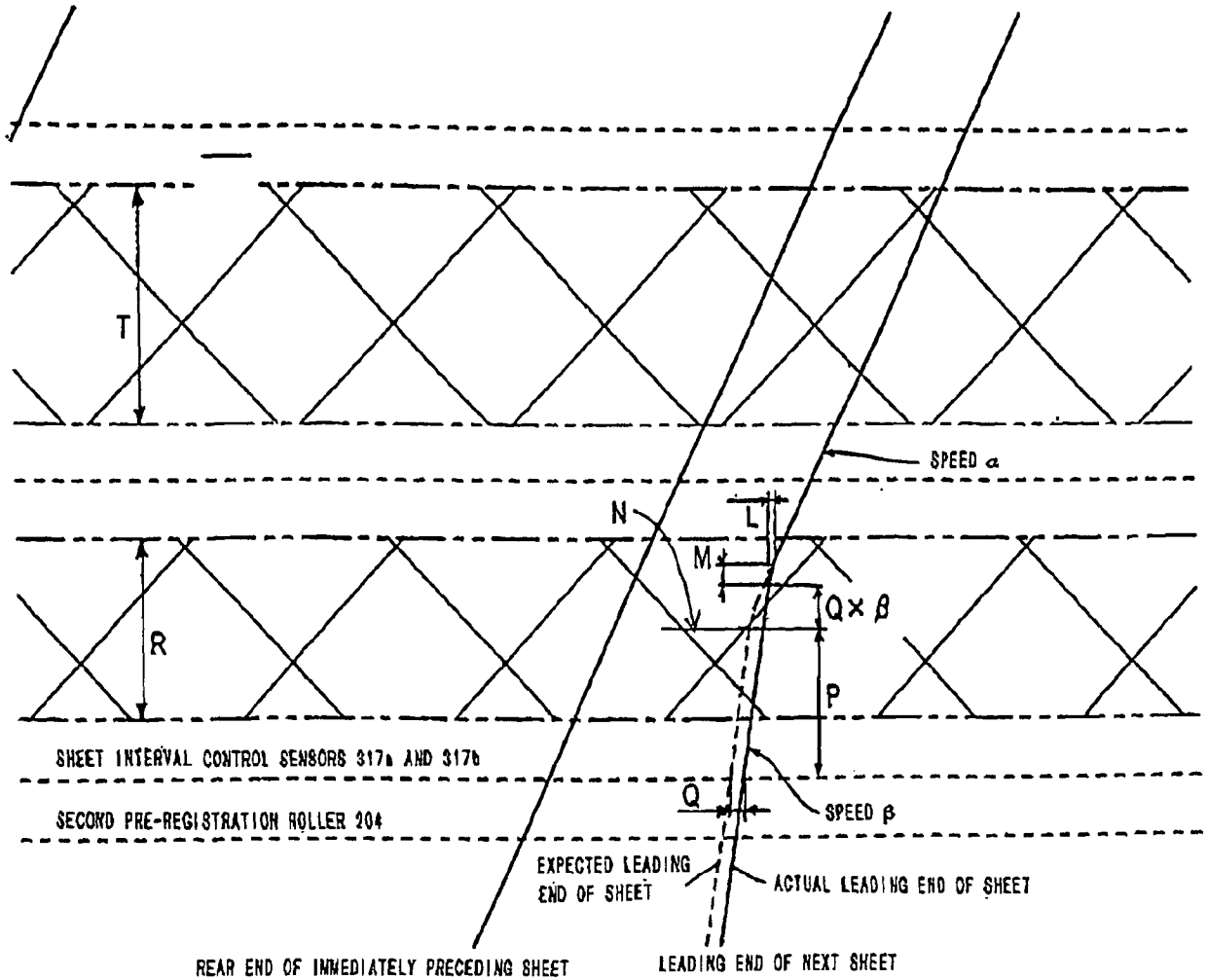
FIG. 8 is a partial enlarged view of the diagram shown in FIG. 5.
Figure 9:
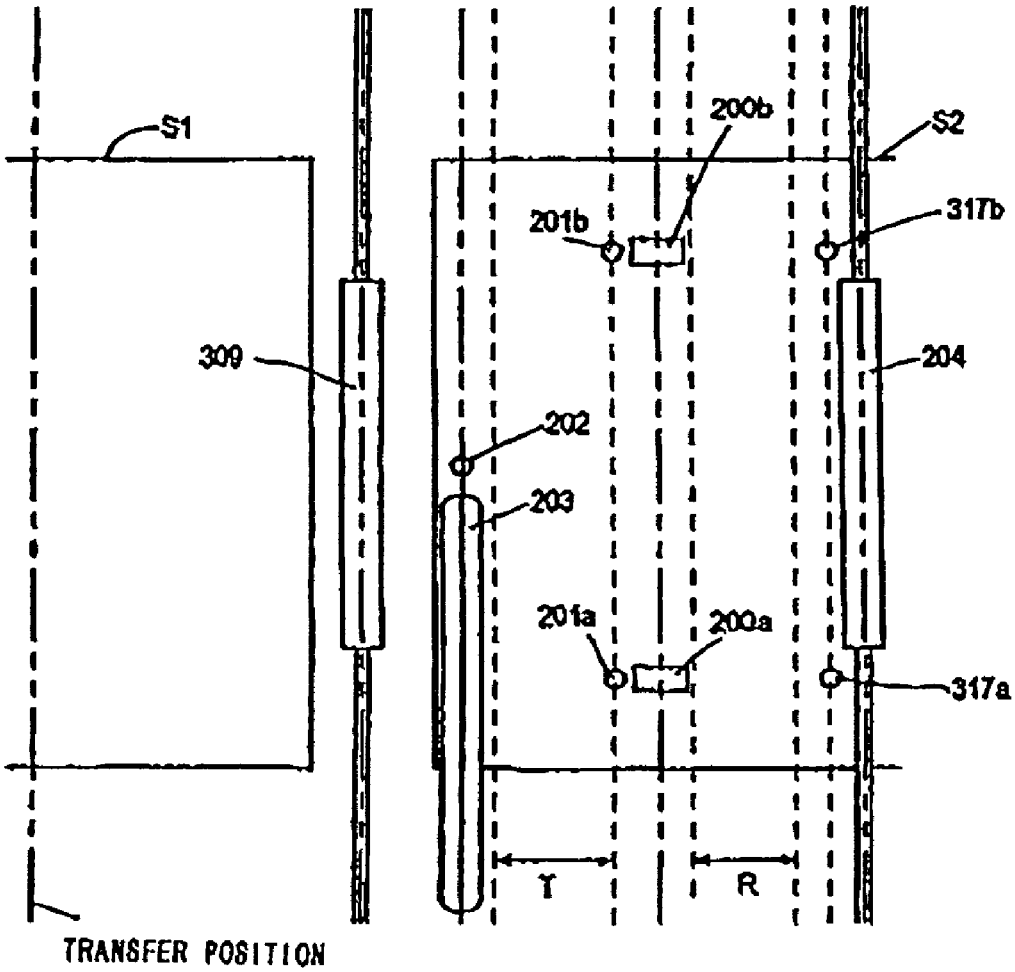
FIG. 9 is a plan view showing skew feeding correction means and sheet interval control means in front of a transfer position in the copying machine according to the embodiment.
Figure 10:
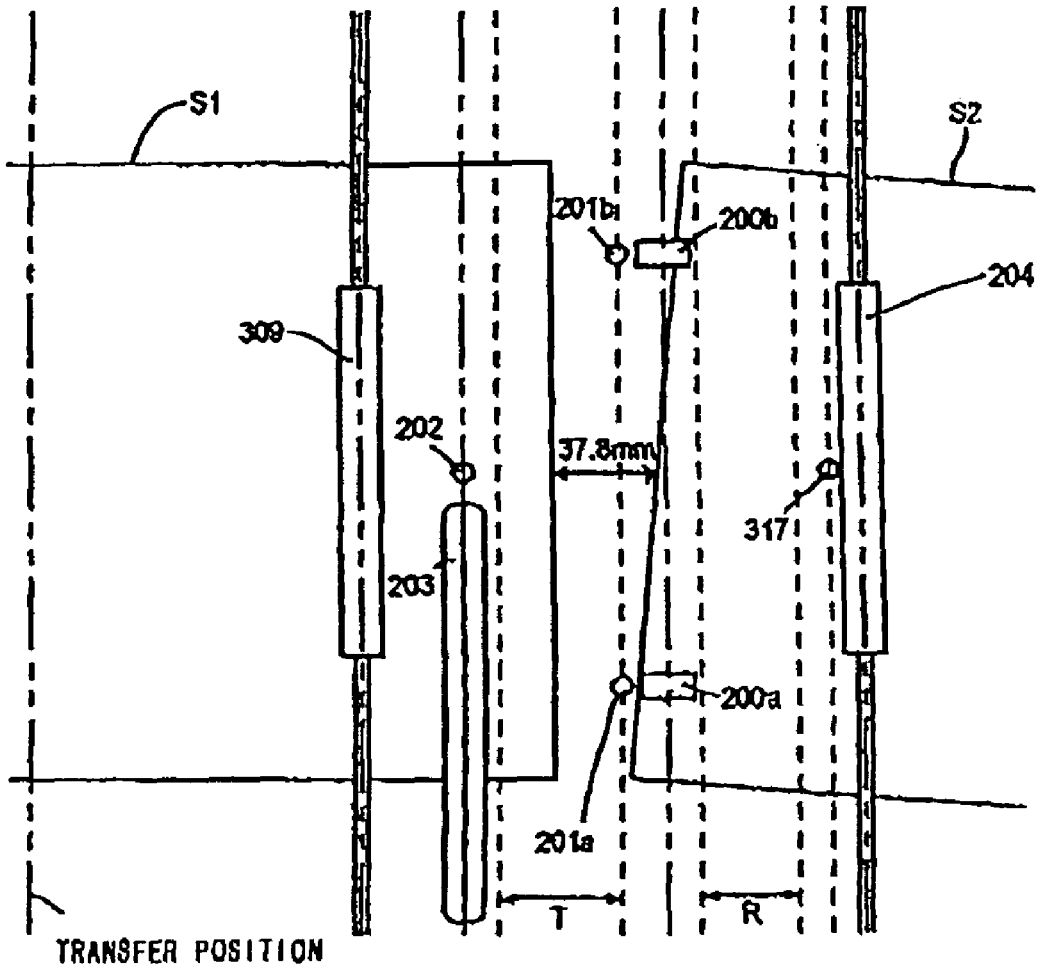
FIG. 10 is a plan view showing a case in which the sheet interval control means has one sensor.
Figure 11:
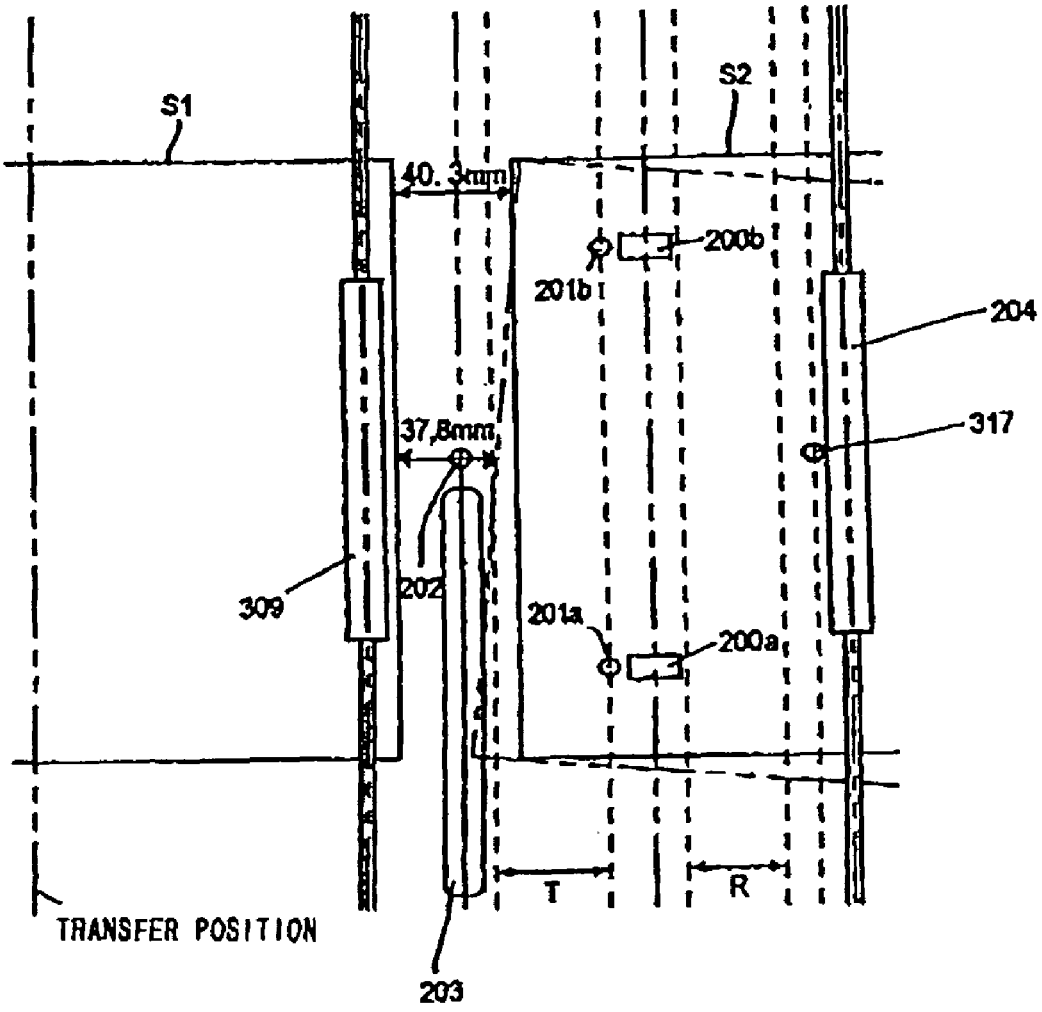
FIG. 11 is a plan view showing a case in which the sheet interval control means has one sensor.
Figure 12:
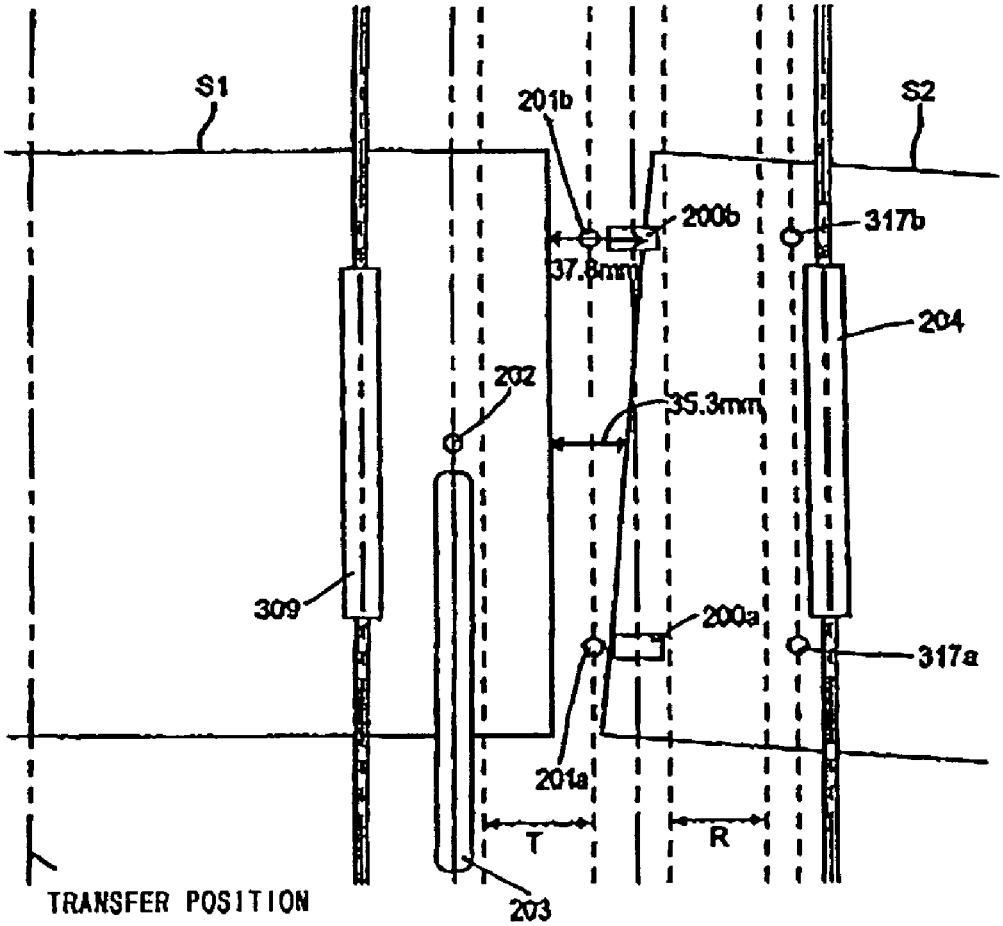
FIG. 12 is a plan view showing skew feeding correction means and sheet interval control means in front of a transfer position in the copying machine according to the embodiment.
Figure 13:
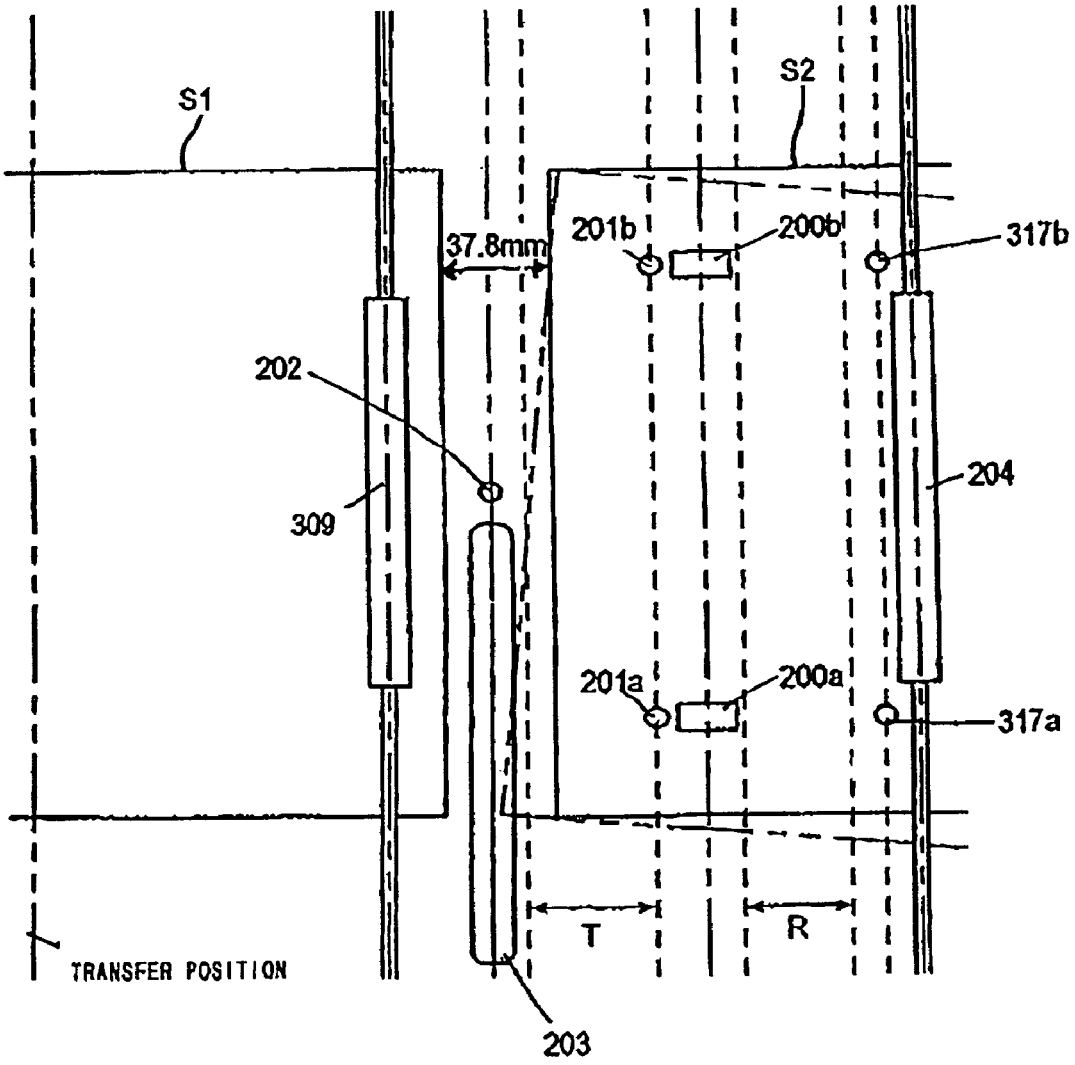
FIG. 13 is a plan view showing skew feeding correction means and sheet interval control means in front of a transfer position in the copying machine according to the embodiment.
Figure 14:
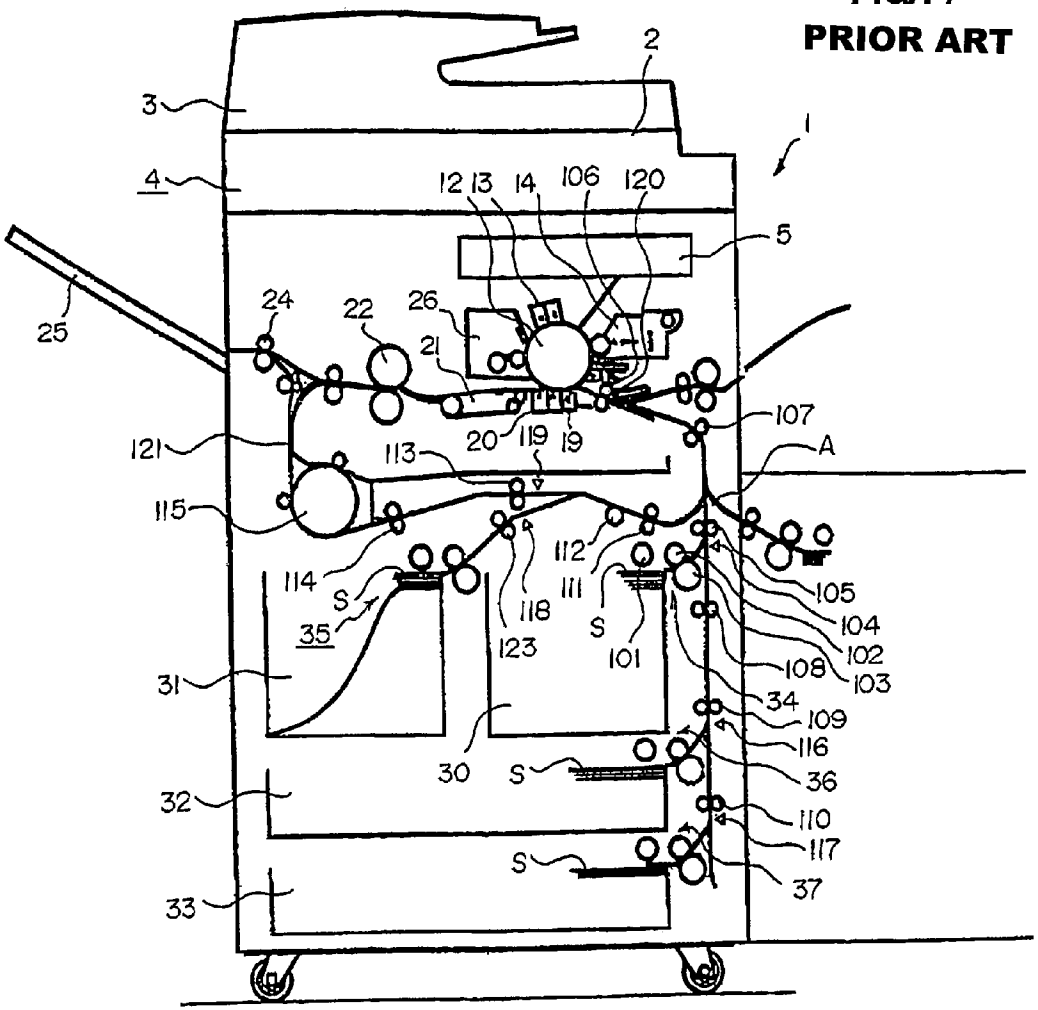
FIG.14 PRIOR ART
FIG. 14 is a diagram showing an essential portion of a conventional apparatus.
Figure 15:
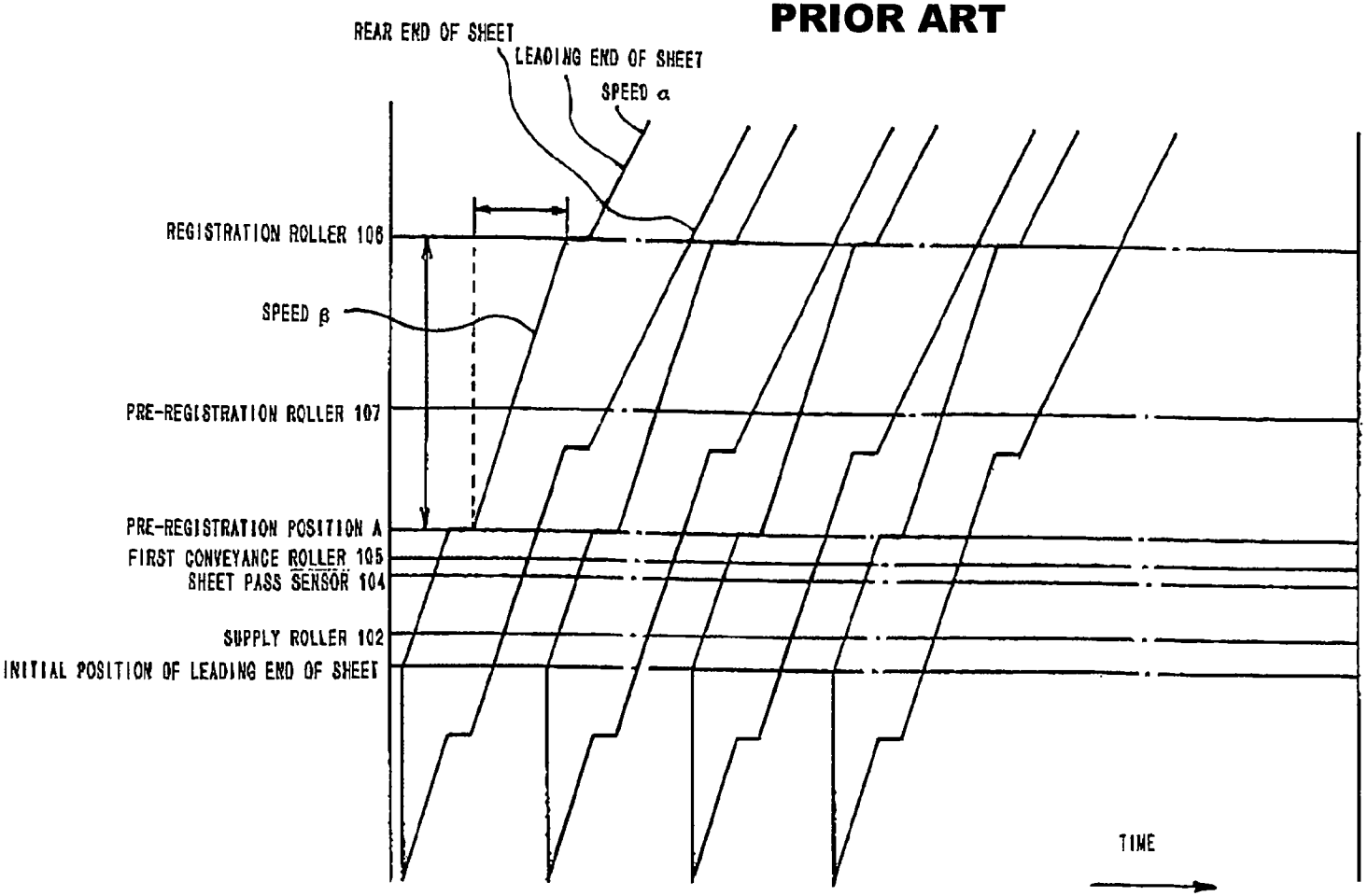
FIG.15 PRIOR ART
FIG. 15 is a diagram showing an essential portion of a conventional apparatus.
Figure 16:
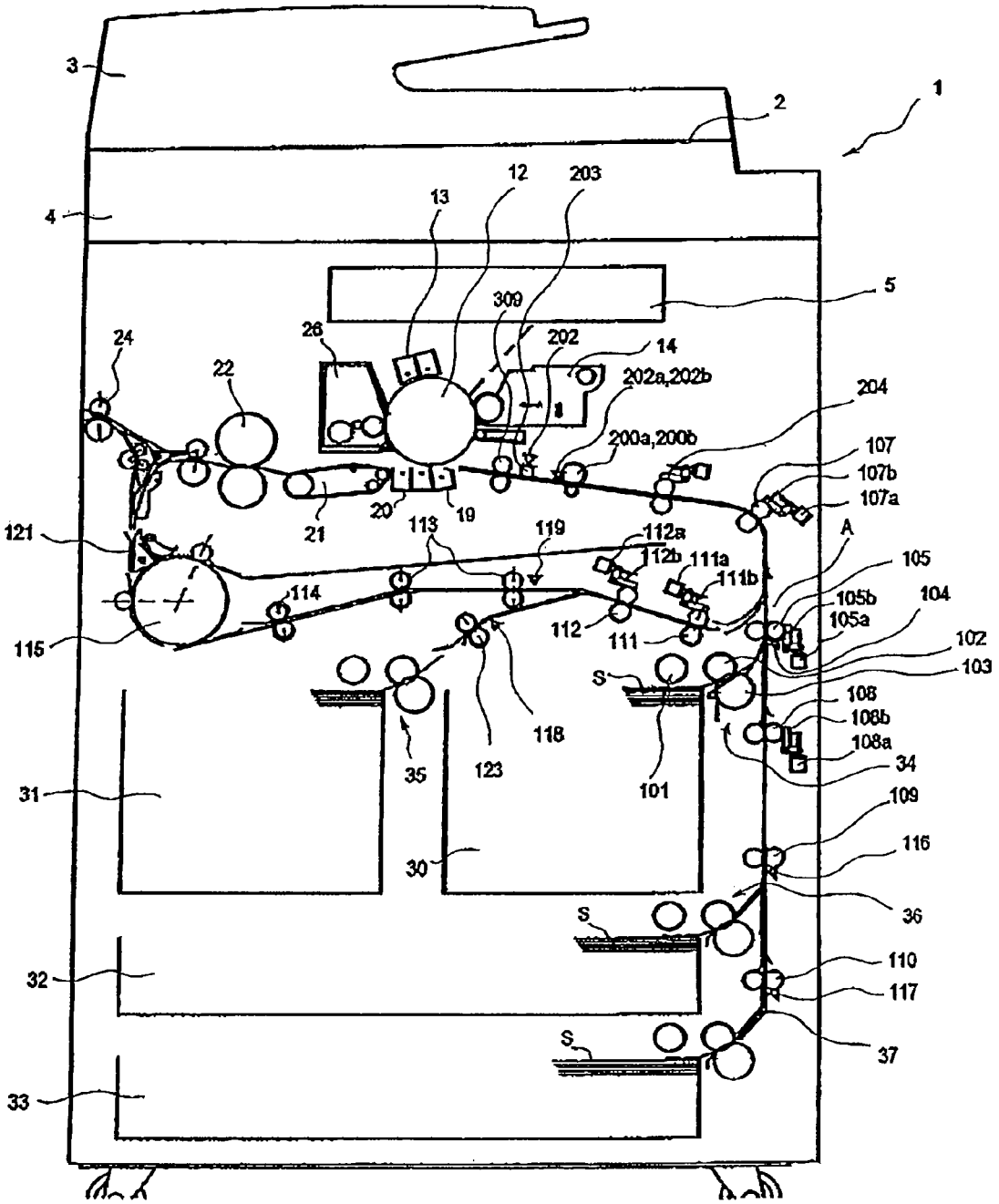
FIG.16 PRIOR ART
FIG. 16 is a diagram showing an essential portion of a conventional apparatus.
Figure 17:
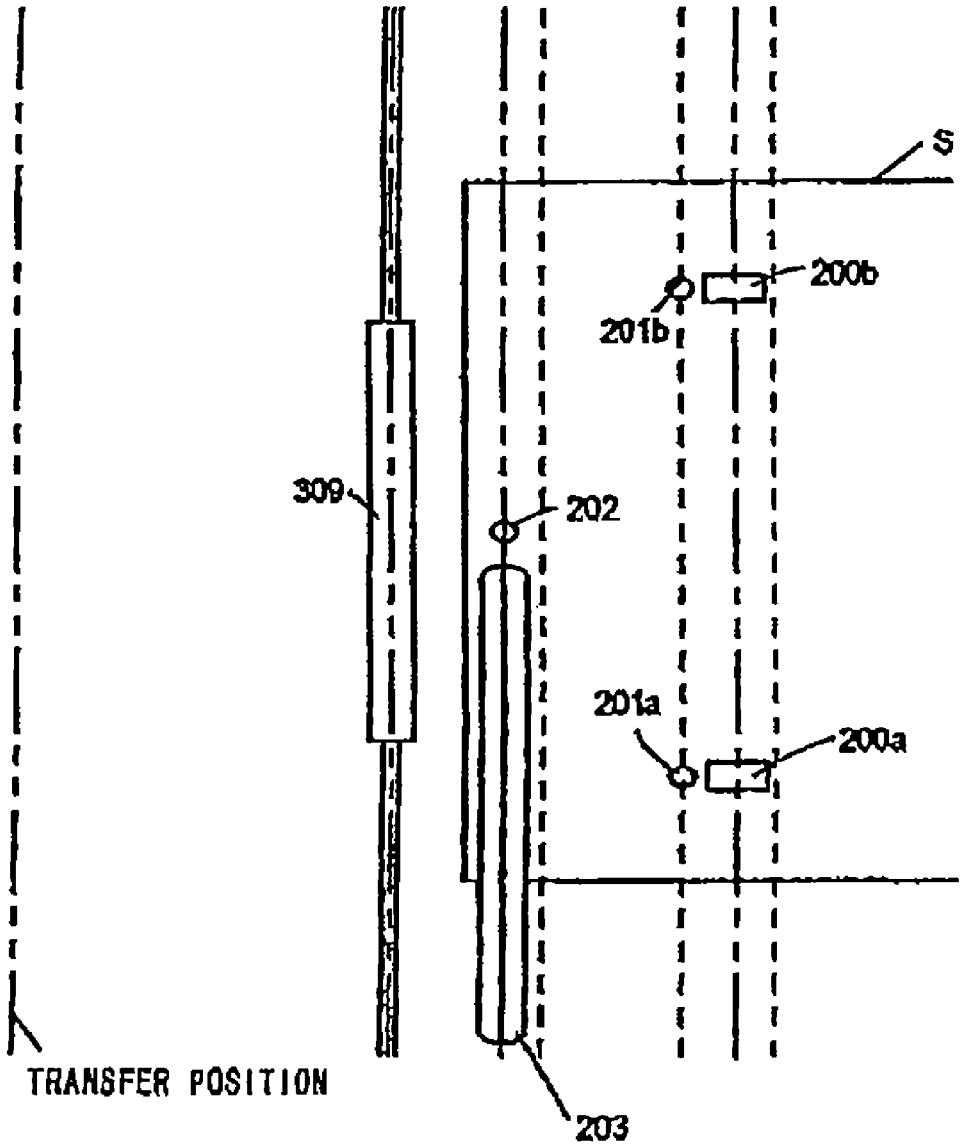
FIG. 17 PRIOR ART
FIG. 17 is a diagram showing an essential portion of a conventional apparatus.

FIG. 1 is a schematic sectional view showing an outline structure of a copying machine according to the embodiment. FIG. 2 is a schematic front view of an image forming unit in the copying machine. FIG. 3 is a sectional view of an essential portion of the image forming unit. FIG. 4 is a side sectional view of two units in the copying machine. FIG. 5 is a diagram showing a positional relation and the like of a leading end and a rear end of a sheet when the sheet is supplied. FIGS. 6 to 8 are partial enlarged views of the diagram shown in FIG. 5. FIGS. 9, 12 and 13 are plan views showing skew feeding correction means and sheet interval control means in front of a transfer position in the copying machine according to the embodiment. FIGS. 10 and 11 are plan views showing a case in which the sheet interval control means has one sensor.

First, units of the copying machine will be explained briefly and then, a control of skew feeding correction of sheet and interval between sheets after a pre-registration operation will be explained.

As shown in FIGS. 1 to 4, in the copying machine according to this embodiment, three units 311, G1 and H1 can be pulled out from a copying machine body (image forming apparatus body). Members of the copying machine having the same functions as those of the above-described conventional technique are designated with the same symbols, and explanation thereof will not be described.

In an image forming unit 311 shown in FIGS. 2 and 3, reference numbers 301 and 302 represent an image forming unit front side plate and an image forming unit rear side plate, and they support the photosensitive member drum 12, the charger 13, the development unit 14 and the cleaner 26. A reference number 303 represents a right frame connecting the image forming unit front side plate 301 and the image forming unit rear side plate 302 with each other. A reference number 304 represents a right lower frame which is located below the development unit 14 and which connects the image forming unit front side plate 301 and the image forming unit rear side plate 302 with each other. A reference number 305 represents a left frame which is located above the cleaner 26 and which connects the image forming unit front side plate 301 and the image forming unit rear side plate 302 with each other. A reference number 306 represents a registration upper guide which functions as a frame connecting the image forming unit front side plate 301 and the image forming unit rear side plate 302, and also functions as a guide of one of sheet guides at the registration unit. Reference numbers 306*a* and 306*b* represent positioning holes formed in the registration upper guide 306. Reference number 307*a* and 307*b* represent driving motors (stepping motors) which drives the skew correcting rollers 200*a* and 200*b*, and they are mounted on the right lower frame 304. Reference numbers 308*a* and 308*b* represent driving belts which connect the driving motors 307*a* and 307*b* and the skew correcting rollers 200*a* and 200*b* with each other. The correction sensors 201*a* and 201*b*, the leading end detection sensor 202 and the CIS sensor 203 are supported by the registration upper guide 306. A reference number 309 represents the pre-transfer driving roller located upstream side from the transfer position and downstream side from the skew correcting rollers 200*a* and 200*b*. Ends of shafts 310 of the skew correcting rollers 200*a* and 200*b* are supported by the image forming unit front side plate 301 and the image forming unit rear side plate 302 like the pre-transfer driving roller 309. These members constitute the image forming unit 311. The image forming unit 311 can be pulled out from the copying machine body by the slide rails 311*a* and 311*b* at the time exchange of the development unit 14 and at the time of maintenance of the skew correcting rollers 200*a* and 200*b*, the correction sensors 201*a* and 201*b*, the leading end detection sensor 202, the CIS sensor 203 and the pre-transfer driving roller 309, so that it is easy to access the image forming unit 311. When the image forming unit 311 is pulled out from the copying machine body and when the image forming unit 311 is mounted on the copying machine body, the relative position of the image forming unit 311 in the image forming unit is not deviated.

As shown in FIGS. 1 and 4, the unit G1 includes a registration lower guide unit 312. The registration lower guide unit 312 is provided with a registration lower guide 313 such that it is opposed to the registration upper guide 306 of the image forming unit 311. The registration lower guide 313 is provided with registration lower guide projections 313*a* and 313*b* which engage with the positioning holes 306*a* and 306*b* of the image forming unit 311. The registration lower guide 313 is provided with a pre-transfer driven roller 314 which is opposed to the pre-transfer driving roller 309 of the image forming unit 311, and with skew correction driven rollers 315*a* and 315*b* which are opposed to the skew correcting rollers 200*a* and 200*b* of the image forming unit 311. The registration lower guide unit 312 can vertically move by an elevator 316. When the registration lower guide unit 312 is in the lifted up position, the registration lower guide projections 313*a* and 313*b* engage with the positioning holes 306*a* and 306*b* of the registration upper guide 306, the pre-transfer driving roller 309, the pre-transfer driven roller 314, the skew correcting rollers 200*a* and 200*b* and the skew correction driven rollers 315*a* and 315*b* abut against the registration lower guide unit 312 so that a sheet can be sandwiched and conveyed. If the registration lower guide unit 312 is lowered, the engagement of the registration lower guide projections 313*a* and 313*b* with respect to the positioning holes 306*a* and 306*b* of the registration upper guide 306 is released, and the pre-transfer driving roller 309, the pre-transfer driven roller 314, the skew correcting rollers 200*a* and 200*b* and the skew correction driven rollers 315*a* and 315*b* are also separated. Reference numbers 317*a* and 317*b* represent sheet interval control sensors and they are located upstream side from the skew correcting rollers 200*a* and 200*b*. These members constitute the unit G1. The unit G1 can be pulled out from the copying machine body forward of the copying machine by slide rails G1*a* and G1*b*.

A resupply unit H1 is used at the time of both-sided copy. As shown in FIGS. 1 and 4, the resupply unit H1 includes the fifth transport roller 111, the sixth transport roller 112, the both-sided right roller 113, the both-sided left roller 114, the inverting roller 115, the seventh transport roller 123 and the like. The resupply unit H1 can be pulled out forward of the copying machine by side rails H1*a* and H1*b*.

In this embodiment, transfer speeds of sheet of the rollers provided on the sheet transport path and the both-sided transport path can be switched by the control unit 130 in the following manner.

That is, the second pre-registration roller 204 and the pre-registration roller 107 shown in FIG. 1, the first transport roller 105 as pre-registration transfer means located upstream side of the pre-registration roller 107 in the sheet conveying direction, and the second transport roller 108 at upstream side of the first transport roller 105 in the sheet conveying direction can be switched between the process speed $\alpha$ which is the sheet transfer speed of the photosensitive member drum 12 and a first speed $\beta$ which is faster than the process speed $\alpha$. These rollers 204, 107, 105 and 108 respectively have release solenoids 204*a*, 107*a*, 105*a* and 108*a* and release arms 204*b*, 107*b*, 105*b* and 108*b*, and if the solenoids are turned ON, the pressure can be released.

Further, the third transport roller 109 located upstream side of the second transport roller 108 in the sheet feeding direction, the fourth transport roller 110 located upstream side of the third transport roller 109 in the sheet feeding direction, the fifth transport roller 111, the sixth transport roller 112 located upstream side of the fifth transport roller 111 in the sheet feeding direction, and the seventh transport roller 123 located upstream side of the sixth transport roller 112 in the sheet feeding direction are rotated and driven at the first speed $\beta$. The fifth transport roller 111 and the sixth transport roller 112 respectively have release solenoids 111*a* and 112*a* and release arms 111*b* and 112*b* for releasing the pressure of the rollers, and if the solenoids are turned ON, the pressure can be released.

The both-sided right roller 113 and the both-sided left roller 114 disposed on the both-sided transport path and the inverting roller 115 disposed in the sheet inverting unit 121 can be switched between the first speed $\beta$ and second speed y used when a sheet is inverted.

The sheet path sensors 104, 116, 117, 118 and 119 are disposed in the same manner as that of the conventional technique, and detection signals of sheet from the sheet path sensors are supplied to the control unit 130. The control unit 130 controls the rotation of the transport rollers based on detection timing from the sheet path sensors.

When sheets are continuously supplied, the control unit 130 carries out the pre-registration operation, the control operation of interval between sheets after the pre-registration operation, and the sheet skew feeding correction operation in succession. Details thereof will be explained later.

The sheet transport operation in the copying machine of this embodiment will be explained based on a case in which sheets are supplied from the deck supply unit 34. FIG. 5 is a diagram showing a positional relation and the like of a leading end and a rear end of a sheet when the sheet is supplied from the deck supply unit 34.

When the supply of the sheets is to be started, the pickup roller 101, the supply roller 102, the separation roller 103, the first transport roller 105 and the pre-registration roller 107 are rotated and driven.

When the sheets are supplied, the sheets S set in the sheet deck 30 are supplied to the supply roller 102 by the pickup roller 101. Only the uppermost sheet is separated from the sheets S by the separation roller 103 which is opposed to the supply roller 102, and to which a force rotating in the opposite direction from the conveying direction with a constant torque is applied.

The leading end of this uppermost sheet is detected by the sheet pass sensor 104, and the sheet is transported by the first transport roller 105.

At that time, to adjust a interval between sheets, i.e., to carry out a so-called pre-registration operation, control is performed in such a manner that the rotation of the first transport roller 105 is temporary stopped based on the detection timing of the sheet leading end by the sheet pass sensor 104, the leading end of the sheet which is being transported by the first transport roller 105 is stopped at a predetermined position on the transport path, and after a predetermined time is elapsed, the rotation of the first transport roller 105 is restarted.

That is, in the sheet transport unit, a sheet whose leading end is in a normal loading position of the sheet deck 30, and a sheet whose leading end is located near the supply roller 102 are also supplied, the leading end positions when the supply is started are largely varied. It is necessary that this variation is corrected by the pre-registration operation which will be explained later, the deviation of interval between sheets generated after the pre-registration operation is reduced using the sheet interval control sensors 317*a* and 317*b* constituting the sheet interval control means after the pre-registration operation and before transfer.

In this embodiment, as shown in FIG. 9, as a structure for correcting the deviation of interval between sheets generated after the pre-registration operation, there is provided the skew feeding correction means (skew correcting rollers 200*a* and 200*b*, correction sensors 201*a* and 201*b* and the like) which corrects the skew feeding of the sheet with respect to the image forming position (transfer position) where an image is formed on the sheet, and which feeds the sheet, and the sheet interval control means which is provided upstream side from the skew feeding correction means in the conveying direction, and which changes the timing of reducing speed from the transfer speed $\beta$ which is faster than the transfer speed $\alpha$ of sheet in the image forming position to the transfer speed $\alpha$, thereby controlling the distance between a rear end of the immediately preceding sheet to a leading end of a next sheet. The sheet transport unit as the sheet transport apparatus comprising the skew feeding correction means and the sheet interval control means is disposed on a sheet transfer path between the sheet transport unit comprising the transport units 34 to 37 and the image forming unit comprising the photosensitive member drum 12.

The sheet interval control means includes the sheet interval control sensors 317*a* and 317*b* as the second detection means, and controls the sheet transfer speed by the transport rollers located upstream side from the sheet interval control sensors 317*a* and 317*b* by means of the control unit 130. With this, the timing for reducing the speed from the transfer speed $\beta$ which is faster than the transfer speed $\alpha$ of sheet in the image forming position to the transfer speed $\alpha$ as described above. Details thereof will be explained later.

Next, the pre-registration operation and the sheet transport unit according to the embodiment will be explained.

As shown in FIGS. 1 and 5, the first transport roller 105 is temporary stopped with timing at which the sheet leading end comes on the predetermined position (pre-registration position) A on the transport path after the sheet leading end is detected by the sheet pass sensor 104, and the stopped position of the sheet leading end is confirmed. Then, control is performed to restart the first transport roller 105 based on time B (B=(distance C to the sheet interval control sensors 317*a* and 317*b*)/(sheet conveying speed $\beta$ of the first transport roller 105 required until the sheet reaches the sheet interval control sensors 317*a* and 317*b*) at which it is assumed that the sheet leading end reaches the sheet interval control sensors 317*a* and 317*b*. If the sheets are to be supplied continuously, restart is carried out such that the leading end of the next sheet reaches the sheet interval control sensors 317*a* and 317*b* when time J is elapsed after the rear end of the rear end of the immediately preceding sheet passes through the sheet interval control sensors 317*a* and 317*b*. The variation in position of the sheet leading end in the sheet transporting unit is corrected by carrying out such a pre-registration operation.

Here, as shown in FIG. 6, the time J can be expressed as $J=(K+M+P)/\alpha-L-P/\beta$, wherein K represents length of a predetermined interval between sheets, L represents time during which speed is reduced from the speed $\beta$ to speed $\alpha$, M represents a distance through which a decelerated sheet moves during the time L, N represents a deceleration position where deceleration is started when a sheet reaches the sheet interval control sensors 317*a* and 317*b* from the pre-registration position A on schedule time B, and P represents a distance between the sheet interval control sensors 317*a* and 317*b*.

However, as shown in FIG. 1, since a sheet passes through a bent path from the pre-registration position A and the sheet interval control sensors 317*a* and 317*b*, the actual time during which the sheet leading end reaches the sheet interval control sensors 317*a* and 317*b* from the pre-registration position A is slightly varied with respect to the expected time B, and slight variation is generated with this variation. Thereupon, as shown in FIGS. 7 and 8, deviation time Q between the actual arrival time to the sheet interval control sensors 317*a* and 317*b* and the expected time B is moved within a range of an area R (area between the sheet interval control sensors 317*a* and 317*b* and the skew correcting rollers 200*a* and 200*b*), i.e., timing at which the speed is reduced from the transfer speed $\beta$ which is faster than the process speed to the transfer speed $\alpha$ which is the process speed is changed, the deviation of interval between sheets is corrected. More specifically, when the arrival time of the sheet leading end at the actual sheet interval control sensors 317*a* and 317*b* is faster than the expected time B by the time Q, a distance between the deceleration position N and the sheet interval control sensors 317*a* and 317*b* is set to $P-Q\times\beta$ as shown in FIG. 7, and if the arrival time is slower than the expected time B by the time Q, the distance between the deceleration position N and the sheet interval control sensors 317*a* and 317*b* is set to $P+Q\times\beta$ as shown in FIG. 8. With this, the deviation of interval between sheets generated after the pre-registration operation is corrected based on the equation expressed with the time J. With this, even if slight deviation of interval between sheets is generated after the pre-registration operation, the slight deviation of interval between sheets can be corrected, and deterioration of productivity caused by the interval between sheets can be prevented.

Next, control for correcting the skew feeding of sheets will be explained in detail. The sheet leading end is sandwiched between the skew correcting rollers 200*a* and 200*b* as transfer rotation bodies constituting the skew feeding correction means, and the skew amount is detected by the correction sensors 201*a* and 201*b* as the first detection means located downstream side of the skew correcting rollers. Then, releasing solenoids 204*a* and 107*a* (also releasing solenoid 105*a* and 108*a* depending upon size of the sheet) are operated, and pressures of the transport rollers located upstream side from the skew correcting rollers 200*a* and 200*b* are released. Next, when the leading end of the sheet is located in an skew feeding correction area T (area between the correction sensors 201*a* and 201*b* and the sensors 202 and 203), the skew correcting roller on the advancing side of the sheet leading end of skew feeding sheet is temporarily decelerated by a correction amount. The skew correcting rollers are rotated and driven by the driving motor (stepping motor). This decelerate control is because that if the stepping motor is accelerated within short time and then the motor is decelerated to its original speed, the possibility that the step motor is brought out of step and stopped becomes high. To avoid this case, after the stepping motor is decelerated, the stepping motor is accelerated to its original speed.

With this, the skew feeding of the sheet is corrected. At the time of correction of skew feeding by the skew correcting rollers, since the pressure of each transport roller located upstream side from the skew correcting roller is released, the skew feeding of the sheet is corrected without resistance. In this embodiment, the skew correcting roller 200*a* and the correction sensor 201*a*, as well as the skew correcting roller 200*b* and the correction sensor 201*b* are disposed on the same axis in the widthwise direction perpendicular to the sheet conveying direction and at symmetric positions with respect to the center in the widthwise direction. Therefore, the difference at the correction sensors 201*a* and 201*b* can be used as a difference in rotation of the skew correcting rollers as it is and thus, complicated calculation for obtaining the skew correction amount of sheet is unnecessary.

Next, when the leading end of the sheet reaches the leading end detection sensor 202 and the CIS sensor 203, the leading end position of the sheet (position of the leading end in the conveying direction) and the lateral end position (end position in the widthwise direction) are detected, and the position detection information is sent to the control unit 130. The writing position by the laser unit 5 with respect to the photosensitive member drum 12 is deviated so that an image is formed at a desired position on the sheet based on this information, and the photosensitive member drum 12 is scanned by the laser unit 5 to form the image. Then, sheets whose interval between sheets and skew feeding are corrected are fed to the transfer position (image forming position), the image on the photosensitive member drum 12 is transferred to the sheet and thus, it is possible to transfer the image on the photosensitive member drum 12 to the sheet precisely.

According to the embodiment, as described above, even when the skew feeding of sheet is dynamically corrected without stopping the sheet leading end after the pre-registration operation, it is possible to prevent the productivity from being deteriorated while maintaining high precision writing to the sheet. That is, it is possible to satisfy both the high precision writing position with respect to a sheet and the productivity. Even when sheets are continuously supplied, the sheets fed to the image forming position are corrected in interval between sheets and skew feeding and thus, the high precision writing on the sheet is maintained, and productivity is not deteriorated and is stable.

In this embodiment, as described above, the transfer speeds of the skew correcting rollers 200*a* and 200*b* are reduced to speeds $\alpha$ which are process speeds from speeds which are faster than process speed before the skew feeding of sheet is corrected by the skew correcting rollers. Therefore, the skew feeding of sheet can be corrected more precisely than a case in which the skew feeding of sheet is corrected at the first speed $\beta$ which is faster than the speed $\alpha$. This will be explained in more detail. If the speed $\alpha$ is 380 mm/s and the speed $\beta$ is 1000 mm/s, and if the driving motors (stepping motors) 307*a* and 307*b* are driven at the revolution number of 3000 PPS, the correction resolving power thereof are 0.127 mm/step and 0.333 mm/step. The precision is varied largely. Thus, if the stepping motor is decelerated before the skew feeding is corrected, the skew feeding of sheet can be corrected more precisely.

In the control of correction of interval between sheets, correction control of interval between sheets when sheet is supplied obliquely will be explained using FIGS. 9 to 13. Here, concrete numeric values are shown as examples, i.e., A4-sized sheets are used, $\alpha$=380 mm/s, 92 PPM (A4), interval between sheets is 37.8 mm, skew correcting roller 200*a* is advanced by 5 mm compared to the skew correcting roller 200*b*.

If the sheet interval control sensor (sheet interval control sensor 317) is provided at only one center location in the widthwise direction as shown in FIGS. 10 and 11, the distance between a rear end of a sheet S1 and a leading end of a sheet S2 at the center of the sheet in its widthwise direction is 37.8 mm as shown in FIG. 10. However after the skew feeding is corrected by delaying the downstream side skew correcting roller 200*a* on the side of the leading end of the sheet S2 in the area T with respect to the skew correcting roller 200*b* by 5 mm, the distance between the rear end of the sheet S1 and the leading end of the sheet S2 at the center of the sheet in the widthwise direction is increased (maximum distance between the sheet S1 and the sheet S2 becomes 40.3 mm), it becomes 91 PPM and the productivity is deteriorated in this state.

Hence, in this embodiment, as shown in FIGS. 9 and 12 to 13, the two sheet interval control sensors 317*a* and 317*b* are provided at the same depth positions as those of the skew correcting rollers 200*a* and 200*b* in the widthwise direction of the sheet. The sheet interval control sensors 317*a* and 317*b* are provided on the same axis in the widthwise direction of the sheet and on the same straight line of the skew correcting rollers 200*a* and 200*b* in the sheet conveying direction. According to this structure, if the distance between the sheets S1 and S2 is adjusted not based on the distance between the sheets S1 and S2 at the center in the widthwise direction of the sheet, but based on the distance between the sheets S1 and S2 at the sheet interval control sensor 317*b* (one side in the widthwise direction) which detected the leading end of the sheet S2 later (complicated calculation is unnecessary because of the same depth positions as those of the skew correcting rollers 200*a* and 200*b*), the distance between the sheets S1 and S2 on the side of the skew correcting roller 200*b* becomes 37.8 mm and the distance between the sheets S1 and S2 at the center in the widthwise direction of the sheet becomes 35.3 mm at a location out of the area R as shown in FIG. 12. Then, after the skew feeding is corrected by delaying the leading skew correcting roller 200*a* on the side of the sheet leading end in the sheet S2 in the area T with respect to the skew correcting roller 200*b* by 5 mm, the distance between the sheets S1 and S2 on the side of the skew correcting roller 200*b* is left 37.8 as it is as shown in FIG. 13, i.e., the distance between the sheets is stable and becomes 92 PPM, and it is possible to satisfy both the precise writing position to the sheet and the productivity.

Although the copying machine is indicated as the example of the image forming apparatus in the above embodiment, the present invention is not limited to this, the image forming apparatus may be a printer, a facsimile machine, a multifunction machine comprising a combination of the printer and the facsimile machine, and the like. If the present invention is applied to a sheet transport unit of such an image forming apparatus, the same effect can be obtained.

Although the electrophotographic type image forming method is employed in the embodiment, the invention is not limited to this, and other image forming methods such as an ink-jet method may be employed.

CROSS-REFERENCE TO RELATED APPLICATION

This application claims the benefit of priority from the prior Japanese Patent Application No. 2004-258389 filed on Sep. 6, 2004 the entire contents of which are incorporated by reference herein.

What is claimed is:

1. An image forming apparatus comprising;

an image forming unit which forms an image on a sheet;

sheet transport unit configured to convey sheets at a transfer speed that is the same as a transfer speed cc of a sheet in an image forming position where an image is formed on the sheet, and at a transfer speed β that is faster than the transfer speed α, skew correction unit configured to correct skew feeding of the sheet conveyed by the sheet transport unit and which feeds the sheet to the image forming position where the image is formed, and the skew correction unit includes a plurality of transfer rotation bodies whose sheet conveying speed can be controlled independently, the plurality of transfer rotation bodies are provided on the same axis in a widthwise direction perpendicular to the sheet conveying direction, and sheet interval control unit configured to adjust a distance between a sheet and a next sheet by changing timing at which the transfer speed of the sheet is reduced from the transfer speed β to the transfer speed cc at an upstream side from the skew correction unit in a sheet conveying direction, the sheet interval control unit includes two sheet interval control sensors which detect the sheet leading end, the sheet interval control sensors are located on the same axis in the widthwise direction perpendicular to the sheet conveying direction and each on the same straight line in the sheet conveying direction with respect to one of the transfer rotation bodies of the skew correction unit, wherein the sheet interval control unit controls the sheet conveying speeds of the plurality of transfer rotation bodies to adjust a distance between a rear end of the immediately preceding sheet and a leading end of the sheet based on detection information of the sheet interval control sensor which detected the sheet leading end of a later side of the sheet in the widthwise direction perpendicular to the sheet conveying direction and the skew correction unit corrects the skew feeding of sheet to decelerate an advancing side of the sheet in the widthwise direction perpendicular to the sheet conveying direction after adjustment of the distance by the sheet interval control unit.

2. An image forming apparatus according to claim 1, wherein the sheet transport unit temporarily stops the sheets supplied from a sheet supplying unit, starts conveying a sheet such that a distance between the sheet and the immediately preceding sheet becomes constant and conveys the sheets to the skew correction unit, and the sheet interval control unit corrects a deviation of distance between sheets generated while the sheets reach the skew correction unit from the stopped position.

3. An image forming apparatus according to claim 1 wherein said skew correction unit corrects the sheet skew by decelerating one of the transfer rotation bodies.

4. An image forming apparatus according to claim 1, wherein the skew correction unit includes two correction sensors which detect a leading end of the sheet, the correction sensors are located in the vicinity of downstream sides of the transfer rotation bodies and on the same axis in the widthwise direction of the sheet, the skew correction unit uses a difference of detection of the sheet leading end by the correction sensors as a speed difference of the transfer rotation bodies.

* * * * *